United States Patent [19]

Okajima

[11] Patent Number: 4,892,196

[45] Date of Patent: Jan. 9, 1990

[54] PARTITION WALL FOR PACKING COMPRESSORS

[75] Inventor: Yoshiaki Okajima, Gunma, Japan

[73] Assignee: Sanden Corporation, Gunma, Japan

[21] Appl. No.: 186,960

[22] Filed: Apr. 27, 1988

[30] Foreign Application Priority Data

Apr. 27, 1987 [JP] Japan ..... 62-62735[U]

[51] Int. Cl.[4] ..... B65D 81/06

[52] U.S. Cl. ..... 206/523; 206/587; 206/593; 217/27

[58] Field of Search ..... 206/319, 446, 523, 585, 206/587, 591–594; 217/26.5, 27; 220/1.5

[56] References Cited

U.S. PATENT DOCUMENTS

| | | | |
|---|---|---|---|
| 3,283,891 | 11/1966 | English, Jr. | 217/27 |
| 3,351,264 | 11/1967 | Bostrom | 206/593 |
| 3,366,231 | 1/1968 | Trakas | 206/585 |
| 3,777,882 | 12/1973 | McIntyre | 206/523 |
| 3,904,030 | 9/1975 | Repp et al. | 206/319 |
| 4,098,400 | 7/1978 | Brown | 206/593 |
| 4,195,732 | 4/1980 | Bell | 206/597 |
| 4,339,040 | 7/1982 | Peil et al. | 206/597 |
| 4,516,677 | 5/1985 | Rowland et al. | 206/597 |
| 4,667,823 | 5/1987 | Wolfe, Jr. et al. | 206/821 |

FOREIGN PATENT DOCUMENTS

| | | | |
|---|---|---|---|
| 2418170 | 10/1979 | France | 206/593 |
| 0589876 | 3/1959 | Italy | 206/821 |
| 2059905 | 4/1981 | United Kingdom | 206/591 |

*Primary Examiner*—Jimmy G. Foster

*Attorney, Agent, or Firm*—Banner, Birch, McKie & Beckett

[57] ABSTRACT

A package for packing a plurality of compressors including a plurality of partition walls for securely laying and stacking compressors is disclosed. The compressors and partition walls are stacked in alternating layers on a pallet. A stretch film is wrapped around the partition wall and compressor layers and the pallet. The partition walls are made of foamed plastic material. The upper and lower end surfaces of the partition walls are formed to fit the outer shape of the compressors. The partition walls can be made more easily and can be precisely dimensioned.

20 Claims, 4 Drawing Sheets

PARTITION WALL FOR PACKING COMPRESSORS

BACKGROUND OF THE INVENTION

1. Technical Field

This invention relates to a partition wall for packing, and more particularly, to a partition wall for use in packing a compressor for an air conditioning system.

2. Description of Related Art

A conventional partition wall for packing a compressor for storage or transport is disclosed in Japanese Utility Model No. 61-38,083. As shown in FIGS. 1(*a*) and 1(*b*), this conventional partition wall includes corrugated boards 10 surrounding urethane foam 11 which acts as a shock absorber. Both sides of the surfaces of the partition wall are formed to fit the outer shape of compressors 12 so that a plurality of compressors can be laid one by one throughout the partition wall.

FIGS. 2(*a*) and 2(*b*) show another conventional partition wall for packing a compressor. This conventional partition wall 20 includes corrugated boards 21 and 22, surrounding urethane foam 23 which acts as a shock absorber. Fitted portion 231 of urethene foam 23 extends outward from openings 211 and 221 of corrugated boards 21 and 22 to receive compressor 40. Fitted portion 231 deforms to fit the outer shape of compressor 40.

In both of these partition walls, because the partition wall includes both a corrugated board and a shock absorber, the process of making the partition wall is complicated. Furthermore, because both a corrugated board and urethane foam are used as a shock absorber, the fit of the partition wall to the shape of the outer surface of the compressor is imprecise. Therefore, compressors can not be properly automatically packaged by an automated system.

SUMMARY OF THE INVENTION

It is an object of the invention to provide a partition wall for packing which is relatively easy to manufacture.

It is another object of the invention to provide a partition wall for packing which precisely fits the outer surfaces of a compressor.

A package according to the present invention includes a plurality of partition walls for securely supporting compressors thereon, a pallet, and a stretch film for wrapping the partition walls and pallet. The partition walls are made of foamed plastic materials with the upper and lower end surfaces of the partition walls formed to fit the shape of the outer surface of the compressors.

Further objects, features, and aspects of this invention will be understood from the following detailed description of the preferred embodiment of this invention with reference to the drawings.

BRIEF DESCRIPTION OF THE DRAWINGS

FIG. 1(*b*) is a cross-sectional view taken along line IV—IV of FIG. 1(*a*).

FIG. 2(*b*) is a cross-sectional view taken along line V—V of FIG. 2(*a*).

FIG. 5(*b*) is a side view of the partition wall of FIG. 5(*a*).

DETAILED DESCRIPTION OF THE INVENTION

Figure 1A:
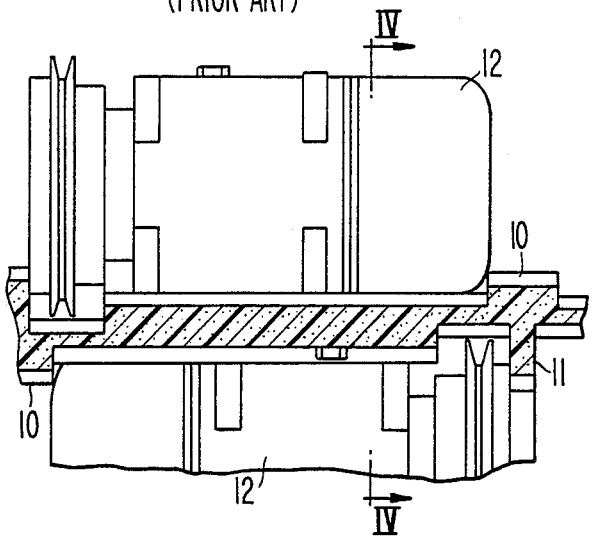
FIG. 1(a). (PRIOR ART)
FIG. 1(*a*) is a cross-sectional view of a conventional partition wall for packing a compressor.
Figure 1B:
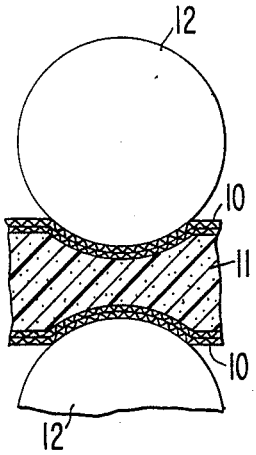
FIG. 1(b). (PRIOR ART)
Figure 2A:
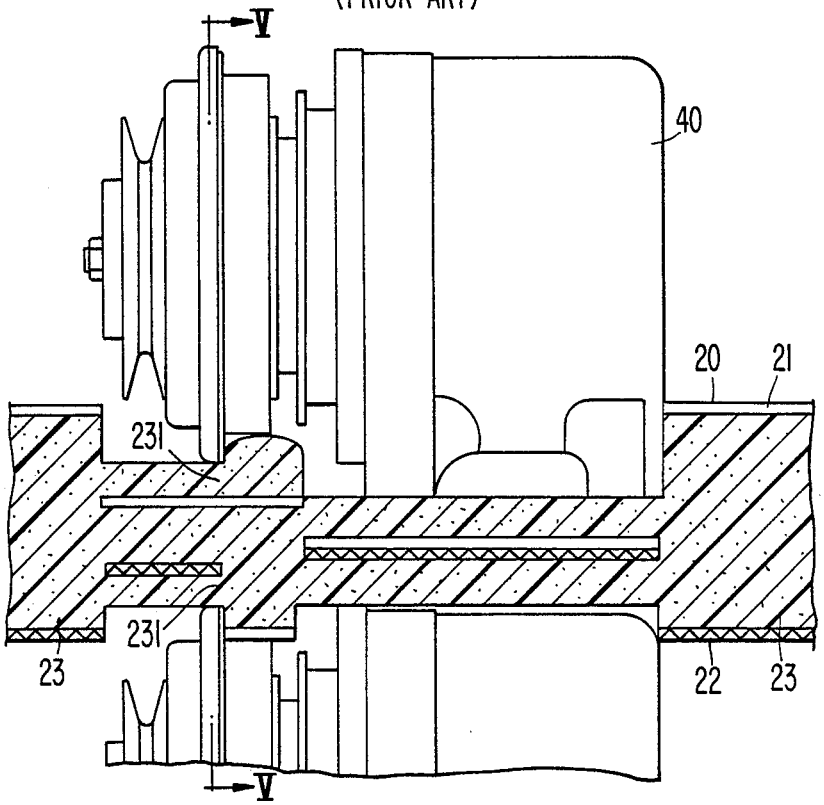
FIG. 2(a). (PRIOR ART)
FIG. 2(*a*) is a cross-sectional view of another conventional partition wall for packing a compressor.
Figure 2B:
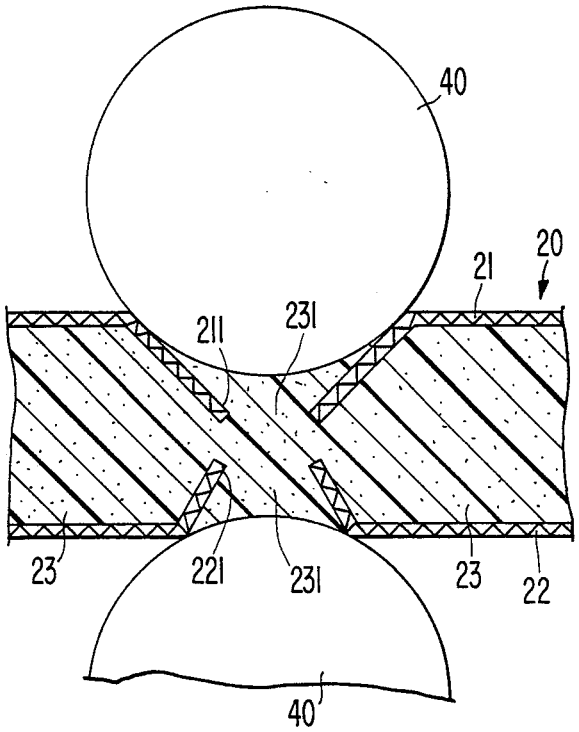
FIG. 2(b). (PRIOR ART)
Figure 3:
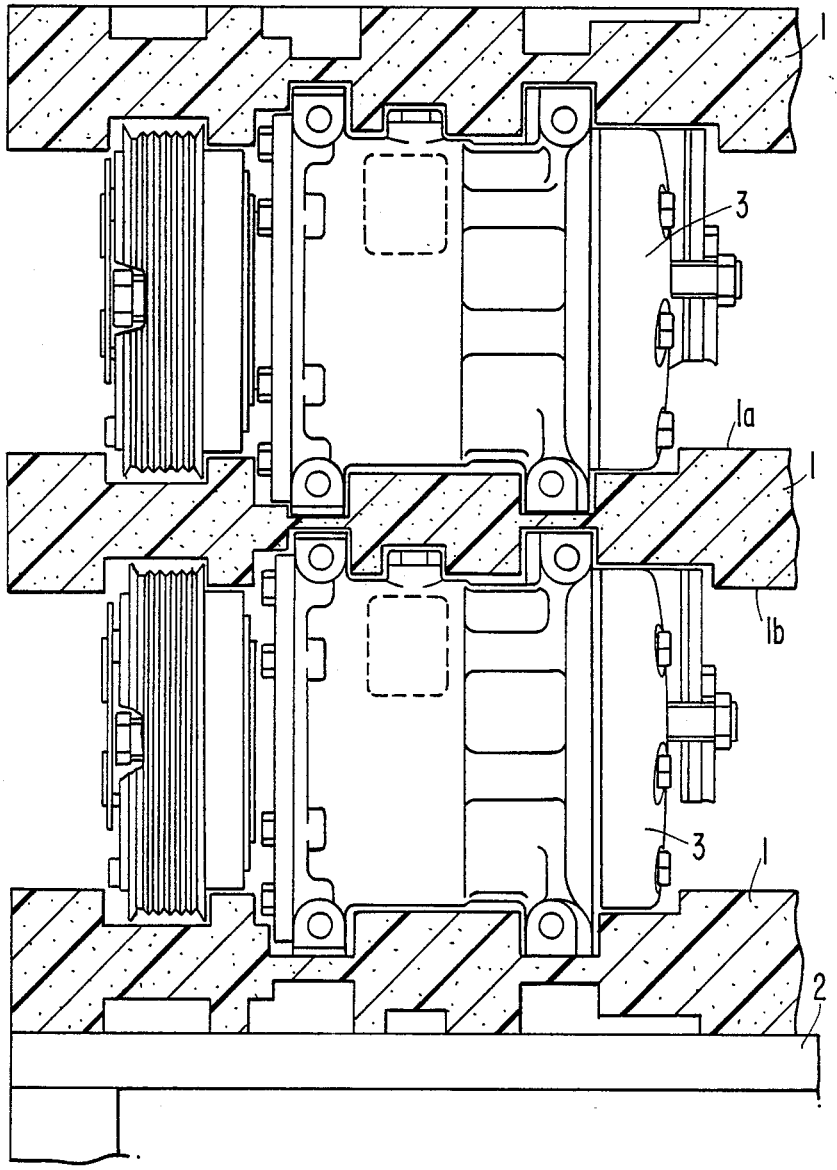
FIG. 3 is a cross-sectional view of partition walls for packing compressors in accordance with one embodiment of this invention.

FIG. 3 shows a partition wall for packing a plurality of compressors in accordance with one embodiment of this invention. Partition wall 1 for packing compressors 3 is made of foamed plastic with shock-absorbing characteristics. Some plastics which may be used include foamed styrol, foamed polyethylene, foamed polypropylene, or copolymerization beads composed of styrol and polyethylene. Upper end surface 1*a* of partition wall 1 is formed to fit closely the outer shape of the lower end of compressor 3, and lower end surface 1*b* of partition wall 1 is formed to fit closely the outer shape of the upper end of compressor 3. Partition wall 1 is integrally formed as one piece by a metal mold.

Figure 4:
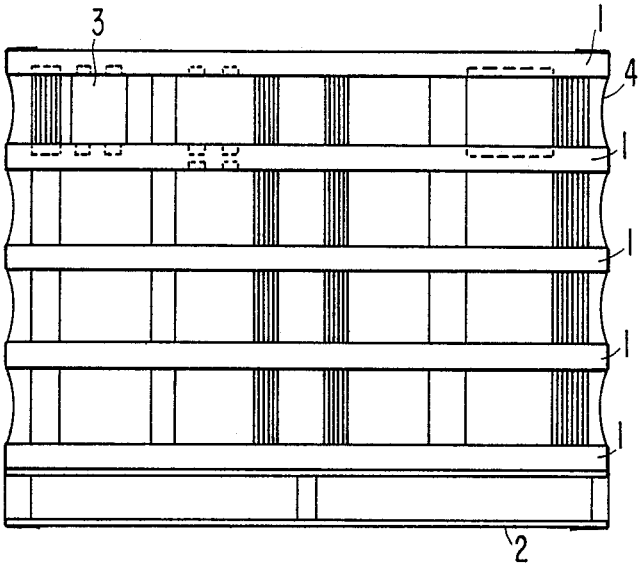
FIG. 4 is a schematic view of a package using the partition wall of FIG. 3.
Figure 5A:
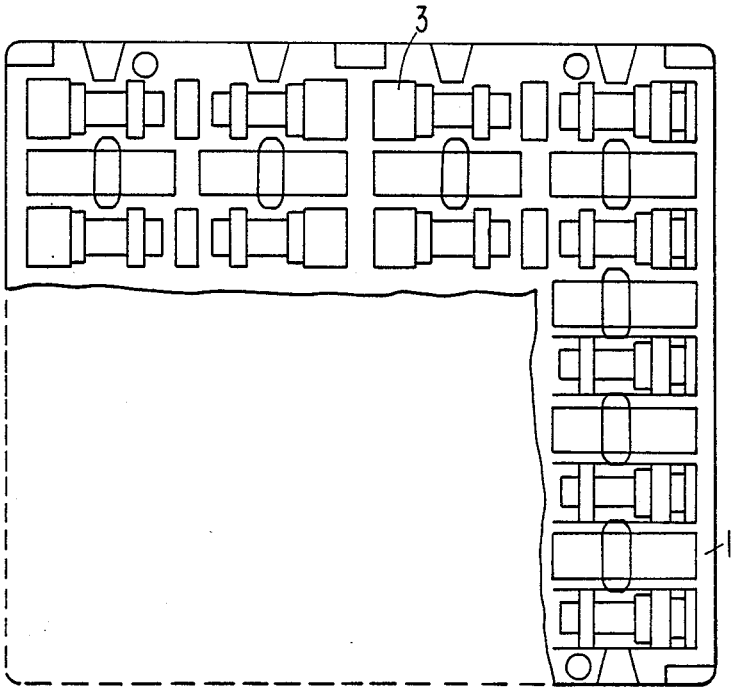
FIG. 5(*a*) is a partial plan view of the partition wall shown in FIG. 3 with compressors supported thereon.
Figure 5B:
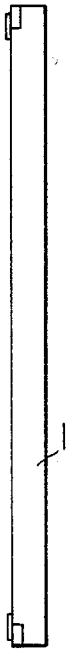

FIG. 4 illustrates a plurality of packed compressors 3 using partition walls 1. In packing, first, a lowermost partition wall 1 is held by pallet 2. Second, a plurality of compressors 3 are laid on partition wall 1 and securely and closely fit compressor-shaped cavities or depressions of the outer surface of partition wall 1. Then, a second partition wall 1 is securely placed on compressors 3 which closely fit within compressor-shaped cavities or depressions of second partition wall 1. As illustrated in FIG. 3, the portion of the partition wall between opposed depressions prevents direct contact between compressors on opposite sides of the wall. The remainder of compressors 3 are laid between additional partition walls 1 in a similar manner. Finally, stretch film 4 is wrapped around pallet 2 and the alternating layers of partition walls 1 and compressors 3. Stretch film 4 may be shrink-wrapped around the package.

While this invention has been described in detail in connection with the preferred embodiment, it is to be understood that these are only examples and the invention is not restricted thereto. It will be recognized by those skilled in the art that other variations and modifications can be easily made within the scope of this invention.

I claim:

1. A package for a plurality of compressors comprising:

a plurality of partition walls for securely laying compressors thereon, each partition wall consisting of foamed plastic material, both the upper and lower surfaces of each partition wall being formed with cavities which are formed in substantially imperforate portions of said upper and lower surfaces of said partition walls and which are adapted to conform closely to the shape of the compressors so that each said partition wall is disposable on top of a first layer of compressors and a second layer of compressors is disposable on top of each partition wall, thereby permitting the compressors to fit closely within the compressor-shaped cavities in said upper and lower surfaces of said partition walls;

means for supporting said partition walls and plurality of compressors comprising a pallet; and means for wrapping the partition walls and the pallet comprising stretch film.

2. The package of claim 1 wherein said foamed plastic material comprises foamed styrol.

3. The package of claim 1 wherein said foamed plastic material comprises foamed polyethylene.

4. The package of claim 1 wherein said foamed plastic material comprises foamed polypropylene.

5. The package of claim 1 wherein said foamed plastic material comprises copolymerization beads of styrol and polyethlene.

6. The package of claim 1 wherein said partition walls are each molded as a single piece.

7. A partition wall for use in packaging a plurality of compressors, said partition wall consisting of foamed plastic material, wherein both the upper and lower surfaces of said partition wall are provided with cavities formed in substantially imperforate portions of said upper and lower surfaces of said partition wall, each cavity closely conforming to a portion of the contour of a compressor, so that said partition wall is disposable on top of a first layer of compressors and a second layer of compressors is disposable on top of said partition wall thereby permitting the compressors to fit closely within the compressor-shaped cavities in said upper and lower surfaces of said partition wall.

8. The partition wall of claim 7 wherein said partition wall is molded as a single piece.

9. The partition wall of claim 7 wherein said foamed plastic material comprises foamed styrol.

10. The partition wall of claim 7 wherein said foamed plastic material comprises foamed polyethylene.

11. The partition wall of claim 7 wherein said foamed plastic material comprises foamed polypropylene.

12. The partition wall of claim 7 wherein said foamed plastic material comprises copolymerization beads of styrol and polyethylene.

13. A packaging system comprising a plurality of compressors in combination with a plurality of stacked partition walls, each partition wall consisting of a single material and having means for receiving a number of said compressors on both the upper and lower outer surfaces thereof, said receiving means comprising a plurality of depressions formed to closely conform to the contour of said compressors, said depressions being formed in substantially imperforate portions of said partition walls, thereby preventing contact between compressors on opposite sides of a partition wall said plurality of compressors being packed between said partition walls in said receiving means to form a partition wall-compressor-partition wall arrangement.

14. The packing system of claim 13 wherein said single material comprises foamed plastic material.

15. The packaging system of claim 14 wherein said foamed plastic material comprises foamed styrol.

16. The packaging system of claim 14 wherein said foamed plastic material comprises foamed polyethylene.

17. The packaging system of claim 14 wherein said foamed plastic material comprises foamed polypropylene.

18. The packaging system of claim 14 wherein said foamed plastic material comprises copolymerization beads of styrol and polyethylene.

19. A method of packaging a plurality of compressors comprising the steps of:

supporting a first partition wall consisting of foamed plastic material and having substantially imperforate portions in both the upper and lower surfaces thereof formed with depressions closely conforming to the shape of the compressors;

laying compressors in the depressions formed in the upper surface to form a first layer of compressors; and placing a second partition wall similar to said first partition wall on top of said first layer of compressors so that the compressors securely fit in the depressions formed in the lower surface thereof.

20. The method of claim 19 further comprising the steps of laying a second layer of compressors in the depression formed in the upper surface of said second partition wall and placing a third partition wall similar to said first and second partition walls on top of said second layer of compressors so that the compressors securely fit in the depressions formed in the lower surface of said third partition wall.

* * * * *